US005540442A

United States Patent [19]

Orselli et al.

[11] Patent Number: 5,540,442

[45] Date of Patent: Jul. 30, 1996

[54] ROULETTE GAME APPARATUS AND METHOD WITH ADDITIONAL BETTING OPPORTUNITY

[76] Inventors: Thomas S. Orselli, R.D. #3, Box 489-B, Franklinville, N.J. 08322; John Dunne, 21 Point Dr., Somers Point, N.J. 08244

[21] Appl. No.: 423,098

[22] Filed: Apr. 18, 1995

[51] Int. Cl.[6] ..... A63F 5/00

[52] U.S. Cl. ..... 463/17; 273/142 E; 273/274

[58] Field of Search ..... 273/138 A, 138 R, 273/142 R, 142 E, 142 F, 142 G, 142 H, 142 HA, 274

[56] References Cited

FOREIGN PATENT DOCUMENTS 829381 6/1938 France ..... 273/142 E 844420 7/1939 France ..... 273/142 R 847984 10/1939 France ..... 273/142 R

*Primary Examiner*—Benjamin H. Layno

*Attorney, Agent, or Firm*—Vorys, Sater, Seymour and Pease

[57] ABSTRACT

In a modified roulette game offering an additional betting opportunity with a large payoff for a winning bet, a player, having made a conventional roulette bet on a conventional roulette betting layout, may make a second or side bet on a related betting layout exhibiting only the numbers of the conventional roulette betting layout, without regard to color, parity or position. When the winning bets in the conventional layout are determined by the operation of the roulette wheel, a random number generator also generates and displays one of the conventional roulette numbers, i.e, 1–36, 0 or 00. If the number displayed by the random number generator is the same as the winning number that is determined by the roulette wheel, the side bet on that number is a winning bet.

6 Claims, 1 Drawing Sheet

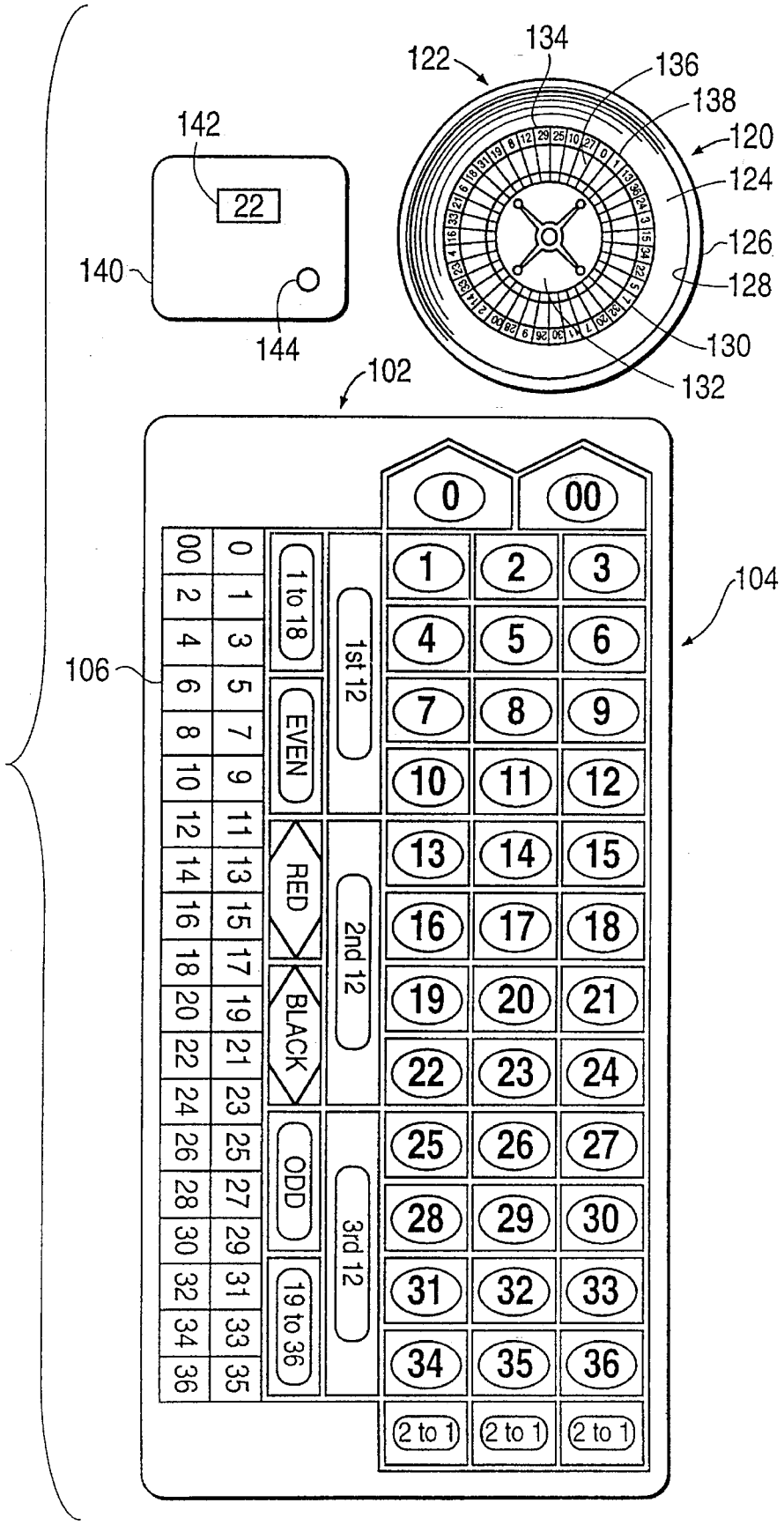
122
134
136
138
120
124
126
128
130
132
142
22
140
144
102
104
106
0
00
1 to 18
EVEN
RED
BLACK
ODD
19 to 36
1st 12
2nd 12
3rd 12
2 to 1

ROULETTE GAME APPARATUS AND METHOD WITH ADDITIONAL BETTING OPPORTUNITY

BACKGROUND OF THE INVENTION

1. Field of the Invention

This invention relates to games of chance and more particularly to an improved form of the classical game of roulette incorporating an additional betting opportunity.

2. Brief Description of the Prior Art

The game of roulette is a well-established game of chance played in casinos worldwide. The roulette wheel itself comprises a horizontal wheel having numbered pockets around its periphery mounted at the bottom of a bowl-shaped housing and adapted to rotate about a vertical axis. The number of each pocket is typically displayed adjacent to the pocket, and each number has an associated color, e.g., red or black, typically indicated by the color of the background on which the number is marked. A conventional American roulette wheel has thirty-eight numbered pockets displaying the numbers 1 through 36 (each assigned a color of red or black), and the house numbers 0 and 00 (typically assigned the color green). In playing the game players bet on the outcome of a number selection made by operation of the roulette wheel as described below. The bets are made on a gaming layout (illustrated in FIG. 1), located on the gaming table adjacent to the wheel, which displays the numbers of the pockets on the roulette wheel and their characteristics, i.e., parity (odd or even) and color (red or black). Players signify their bets on the possible numbers selected by the operation of the roulette wheel by placing chips or markers at predetermined locations on the betting layout. Once the bets have been placed the operator or croupier introduces a small ball into the bowl surrounding the spinning wheel and projects the ball tangentially within the bowl, generally in a direction opposite to the rotation of the wheel. The ball may roll around the interior of the bowl several times before it loses speed and falls toward the center of the bowl, where it encounters the spinning roulette wheel. Eventually the ball becomes trapped in one of the numbered pockets of the wheel, thereby defining the outcome of the play. Bets are paid on the winning outcome i.e., numbers, combinations of numbers or characteristics of the numbers, according to the conventional odds associated with the game of roulette.

Typically, the roulette betting layout as shown in FIG. 1 contains the numbers 1–36 as well as 0 and 00 each displayed in an individual cell on a background of its designated color. (In the layout more common in Europe only the number 0 is used in addition to the numbers 1–36, and the roulette wheel has only thirty-seven pockets.) Bets may be made on individual numbers, by placing markers thereon, or on combinations of adjacent numbers, by placing markers on dividing lines between the numbered cells. Certain locations on the betting layout are defined for bets on certain combinations of numbers, or on red or black, or on odd or even. The payoff odds for a bet on a winning outcome are determined by the probability of the occurrence of a particular outcome. For example, a bet on an individual number pays 35 to 1, a bet on the combination of numbers 1–18 pays 2 to 1, and a bet on odd or even or red or black pays even money.

While roulette is a very popular game, it has suffered in comparison with some other modern games of chance because it does not provide the possibility of a very large payout for any of the defined bets. Traditionally, the greatest return on a bet is 35 to 1, which is the payoff for a bet on a single number. There has been no possibility of a large win such as is possible in certain slot machine gaming devices, for example.

Some attempts have been made to improve upon the established roulette game. U.S. Pat. No. 4,077,631, to Tela, discloses a slightly different arrangement for the numbers on a roulette betting layout which is said to provide a better understanding of the betting for a player. However, this game also does not provide a betting opportunity having a large payout.

U.S. Pat. No. 5,042,810, to Williams, discloses a roulette game in which one or more jackpots are accumulated based on the total amount bet at the table. The jackpots are won when a predetermined event occurs, e.g., the same number occurs on three successive plays. In order to determine the winning player each number is apparently assigned to one of a few groups of numbers, each group identified by a unique color, and the players use chips of corresponding colors in playing. The jackpot is paid to the player playing with chips of the color to which the winning number is assigned. This scheme adds to the game of roulette a jackpot feature that pays a large sum. However, the payout bears little or no relation to the bettor's choice of numbers.

U.S. Pat. No. 5,259,616, to Bergman, discloses a slot machine having a display that resembles a simplified roulette wheel. The player places a bet by depositing a coin or the like and selects a number by depressing a key. The machine then generates one of the numbers on the wheel display using a random number generator. If the chosen number is generated, a second random number generator determines a multiplier that determines the value of the payout for the win. The slot machine game of Bergman, however, resembles a conventional slot machine, and is not such as to appeal to person interested in playing the classical game of roulette.

U.S. Pat. No. 3,770,269, to Elder, discloses a slot machine-type game having a display area exhibiting a collection of numbers, typically the digits 0 through 9. A player places a bet by inserting a coin or the like, selects a number by pressing a selection button and initiates play by pressing a start button. The machine proceeds to illuminate the numbers in a random order, each number being illuminated for a brief period of time. The player tries to stop the display on his chosen number by depressing a stop button while his chosen number is illuminated. If he is successful the machine pays a reward. If the player does not make a selection within a predetermined period of time the machine will automatically stop at one of the numbers at random and pay if that random number is the same as the number selected by the player. This machine resembles a pure random number matching game, and would not be expected to appeal to the person seeking to play classical roulette.

Consequently, a need has continued to exist for a roulette game that enhances interest in the game by enabling the possibility of a large payout for a single bet.

SUMMARY OF THE INVENTION

This need has now been met by the roulette game of this invention wherein a player, having made a conventional roulette bet, may make a second or side bet on the individual numbers of the roulette wheel by placing a marker on a related betting layout exhibiting only the numbers in individual cells, without regard to color or parity. Each time a conventional roulette play is made by operating the roulette wheel a described above, a random number generator is also actuated, which generates and displays one of the conventional roulette numbers, i.e, 1–36, 0 or 00. If the number displayed by the random number generator is the same as the winning number that is selected by the roulette wheel, the side bet is on that number is also a winning bet and a payout is made to those players who have placed side bets on the winning number. Because the probability of a coincidence of the number selected by the roulette wheel and that generated by the random number generator is rather small, the payout for a win on the side bet can be substantial, and typically odds of 1000 to 1 can be paid.

Accordingly, it is an object of the invention to provide a modified roulette game.

A further object is to provide a roulette game offering the opportunity for a large payout.

A further object is to provide a roulette game having greater interest to players by reason of an additional opportunity to bet.

Further objects of the invention will become apparent from the description which follows.

BRIEF DESCRIPTION OF THE DRAWING

The sole FIGURE illustrates the apparates and gaming table layout for playing the roulette game of the invention.

DETAILED DESCRIPTION OF THE INVENTION AND PREFERRED EMBODIMENTS

According to the invention a conventional roulette game is provided with additional opportunities to place bets and win a large payout by providing a second betting layout in addition to the conventional roulette betting layout. The second betting layout comprises a simple arrangement of the numbers 1 through 36, 0 and 00. Players who have placed bets on the conventional roulette betting layout may place additional bets on the second betting layout. A random number generator capable of generating a random number from one to thirty-six plus 0 (zero) and 00 (double zero) is provided which is operated in association with each play of the conventional roulette wheel. If the number generated by the random number generator matches the winning number of the conventional roulette play, the second bet is declared a winning bet and a payout is made. The odds governing the likelihood of a coincidence of the roulette-winning number and the random generated number are such that a fairly large payout, typically 1000 to one, can be paid for a win on the second bet.

The play of the enhanced roulette game of the invention and the apparatus used for playing the game may be understood by reference to the sole FIGURE of the drawing which illustrates a betting layout 102, a roulette wheel assembly 120 and a random number generator 140. The betting layout 102 comprises a first betting area 104 and a second betting area 106. The first betting area 104 is a conventional roulette betting layout. The numbers 1–36 are arranged in twelve rows of three numbers each, forming a pattern of three columns and 12 rows of numbers, each number being arbitrarily assigned a color of red or black. At one end of the roulette betting layout 104 the numbers 0 and 00 appear, which are the house numbers and represent a win for the house when they are selected by the roulette wheel. At one end and at the side of the roulette betting area 104 are small areas that represent bets on particular groups of numbers or particular characteristics of the numbers (odd-even, red-black). Betting in the roulette betting area 104 is conventional and is signified by placing markers, e.g., chips, on the numbers or on intersections of rows and/or columns to signify a bet on groups of numbers or on areas representing characteristics of the numbers, e.g., red or black. Payouts for winning bets in the roulette betting area 104 are also made according to the conventional method of roulette play.

If a player has made a conventional roulette bet in the roulette betting area 104 the player becomes eligible to place a second bet in the second betting area 106. In this second betting area 106 only the number is of significance for determining a winning bet.

In the play of the modified roulette game of the invention players place bets in the roulette betting area 104 according to the conventional roulette betting procedures and, if they wish to participate in the side betting opportunity of the game of this invention, also in the second betting area 106. Winning bets placed in the roulette betting area are determined by conventional roulette play using a roulette wheel 130 mounted in a conventional roulette wheel assembly 120. Such an assembly comprises a bowl 122 having an inwardly sloping bottom 124, a wall 126, and a rim 128. The roulette wheel 130 is mounted centrally in the bottom 124 of the bowl 122 with its upper surface 132 generally continuous with the bottom 124. A number of pockets 136 are arranged around the rim 134 of the roulette wheel 130. The pockets are sized to receive and retain a small ball, and each pocket is associated with a number 138. In the roulette play, the croupier introduces a ball into the bowl 122 of the roulette wheel assembly 120 wherein the roulette wheel is 130 is spinning, and typically gives the ball a tangential velocity in a direction opposite to the spinning roulette wheel 130. The ball is confined by the wall 126 and rim 128 of the bowl 122 and eventually loses momentum and descends across the bottom 124 of the bowl 122 and encounters the spinning roulette wheel 130. The ball becomes entrapped in one of the numbered pockets 136 of the roulette wheel 130 thereby selecting the winning number for the roulette play. Bets made in the roulette betting area are paid off according to the conventional roulette scheme.

At the same time as the roulette play is started, or shortly therebefore or thereafter, the random number generator 140 is started. The random number generator 140 may be started by any conventional means such as, for example, by the croupier pressing a start button 144 located either on the random number generator itself, as shown, or at a remote location. It will be understood that the random number generator could also be started by other means, e.g., a footswitch operated by the croupier, or by some automatic means actuated by the introduction of the ball into the bowl 122 of the roulette wheel assembly 120. The random number generator 140 comprises conventional means not shown for rapidly generating random numbers from among the set of possible numbers in the game of roulette, i.e., one through 36, 0 and 00. The numbers generated by the random number generating means are displayed on the display 142 as illustrated in the drawing, for example, by the display of number "22". Electronic random number generators and associated circuitry for displaying the numbers on a visible display are well-known, and any suitable generator and display can be used. The display may be located on a housing containing the random number generator, or it may be located remotely and connected to the random number generator by conventional means. Typically, the random number generator 140 generates and displays the numbers rapidly, whereby the display 142 is rapidly changing. After a predetermined period of time, e.g., as determined by a clock or when the ball is trapped in a pocket 136 of the roulette wheel 130 to select the winning roulette number, the random number generator 140 is stopped and the display 142 is fixed at the final random number generated. If the number generated by the random number generator 140 is the same as the winning roulette number selected by the roulette wheel assembly 120, the number is considered a winning number for bets placed in the second betting area 104, and such bets are paid off at predetermined odds. The payout for such winning bets can be significantly higher than for conventional roulette bets because the probability of a coincidence between the roulette winning number as selected by the roulette wheel and the random number generated by the random number generator is small, and a winning bet will occur relatively seldom. Statistically, coincidence of the roulette winning number and the random number generated by the random number generator would be expected to occur once in 1444 plays. Hence, a payout of 1000 to one is possible while still providing a margin for the casino.

While the apparatus and method of the roulette game of the invention have been described above in terms of the conventional game of roulette played in North America, it will be understood by those skilled in the art that variations may be made. For example, the roulette wheel and betting layout may have more numbers, fewer numbers or different numbers from those discussed above. In particular, in the version of roulette more commonly played in Europe there is no number 00. Such games having more, fewer or different numbers are intended to be included within the scope of this invention.

The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than the foregoing description, and all changes which come within the meaning and range of equivalency of the claims are intended to be embraced therein.

I claim:

1. A roulette game apparatus comprising only one roulette wheel assembly comprising a bowl having a bottom, a side wall and a rim, said bowl being capable of confining a ball introduced thereinto whereby said ball is directed by gravity to the bottom of said bowl, and a roulette wheel mounted coaxially and rotatably in the bottom of said bowl, said roulette wheel having an upper surface generally continuous with said bottom of said bowl and a rim, said roulette wheel being provided with pockets on said upper surface adjacent said rim, each of said pockets having a number associated therewith, at least some of said numbers being characterized as odd or even, and at least some of said pockets having a color associated therewith, said color being selected from a group consisting of two distinguishable colors, each of said pockets being sized to receive and retain said ball, whereby when said ball is retained in one of said pockets an outcome of play is determined and said number associated with said pocket is determined as a winning number, said outcome being characterized as odd or even and of the color associated with said winning number, a random number generator capable of generating and displaying a random number selected from the group consisting of said numbers associated with said pockets of said roulette wheel, a betting layout having a first betting area and a second betting area, said first betting area having locations distinguished by said distinguishable colors for placing bets on said numbers associated with said pockets of said roulette wheel and on combinations of said numbers, and said first betting area additionally having locations for placing bets on said odd or even outcomes or said outcomes characterized by one of said distinguishable colors, said second betting area having locations for placing bets on said numbers associated with said pockets of said roulette wheel, wherein said locations in said second betting area contain a duplicate set of said numbers in said locations in said first betting area, and colors of said locations in said second betting area do not distinguish said locations in said second betting area for determining a winning or losing bet placed in said second betting area as said colors distinguish said locations in said first betting area.

2. The apparatus of claim 1 wherein said number is a number selected from the group consisting of the numbers one through thirty-six, and one or both of the numbers 0 and 00.

3. The apparatus of claim 1 wherein said distinguishable colors are red and black.

4. A method of playing a roulette game comprising providing a roulette wheel assembly comprising a bowl having a bottom, a side wall and a rim, said bowl being capable of confining a ball introduced thereinto whereby said ball is directed by gravity to the bottom of said bowl, and a roulette wheel mounted coaxially and rotatably in the bottom of said bowl, said roulette wheel having an upper surface generally continuous with said bottom of said bowl and a rim, said roulette wheel being provided with pockets on said upper surface adjacent said rim, each of said pockets having a number associated therewith, at least some of said numbers being characterized as odd or even, and at least some of said pockets having a color associated therewith, said color being selected from a group consisting of two distinguishable colors, each of said pockets being sized to receive and retain said ball, whereby when said ball is retained in one of said pockets an outcome of play is determined and said number associated with said pocket is determined as a winning number, said outcome being characterized as odd or even and of the color associated with said winning number, a random number generator capable of generating and displaying a random number selected from the group consisting of said numbers associated with said pockets of said roulette wheel, a betting layout having a first betting area and a second betting area, said first betting area having locations for placing bets on said numbers associated with said pockets of said roulette wheel and on combinations of said numbers, and said first betting area additionally having locations for placing bets on said odd or even outcomes or said outcomes characterized by one of said distinguishable colors, said second betting area having locations for placing bets on said numbers associated with said pockets of said roulette wheel;

accepting a first bet placed by a player in said first betting area and a second bet placed by said player on one of the numbers in said second betting area, spinning said roulette wheel and introducing a ball into said bowl, whereby said ball is received and retained in one of said pockets, declaring the number of said pocket a first winning number, and paying off bets placed in said first betting area on said first winning number and its character as odd or even and as being of one of said two distinguishable colors, in association with said spin of said roulette wheel, actuating said random number generator, whereby one of said random numbers is generated and displayed, declaring said random number a second winning number only if said random number is the same as said first winning number, and paying off bets placed in said second betting area on said second winning number.

5. The method of claim 4 wherein said number is a number selected from the group consisting of the numbers one through thirty-six, and one or both of the numbers 0 and 00.

6. The method of claim 4 wherein said distinguishable colors are red and black.

* * * * *